US008328247B2

(12) United States Patent
Tonelli

(10) Patent No.: US 8,328,247 B2
(45) Date of Patent: Dec. 11, 2012

(54) LOCK, PARTICULARLY FOR SUITCASES, TRUNKS AND THE LIKE

(75) Inventor: Massimo Tonelli, Casalecchio di Reno (IT)

(73) Assignee: G.T. Line S.R.L., Crespellano (IT)

( * ) Notice: Subject to any disclaimer, the term of this patent is extended or adjusted under 35 U.S.C. 154(b) by 439 days.

(21) Appl. No.: 12/585,597

(22) Filed: Sep. 18, 2009

(65) Prior Publication Data

US 2011/0067462 A1 Mar. 24, 2011

(51) Int. Cl.
*E05C 3/02* (2006.01)
*B65D 45/34* (2006.01)

(52) U.S. Cl. ..... 292/194; 292/95; 292/110; 292/247; 292/256.69; 292/DIG. 49

(58) Field of Classification Search ..... 292/95, 292/109, 110, 113, 116–118, 247, 256.69, 292/DIG. 49, 194
See application file for complete search history.

(56) References Cited

U.S. PATENT DOCUMENTS 3,008,745 A * 11/1961 Tomkinson et al. ..... 292/113
3,394,955 A * 7/1968 Martin ..... 292/113
3,709,538 A * 1/1973 Seitz et al. ..... 292/128
4,181,333 A * 1/1980 Stelma ..... 292/66
4,920,771 A * 5/1990 Jiang ..... 70/4
5,024,471 A * 6/1991 Kahl et al. ..... 292/97
5,732,987 A * 3/1998 Wright et al. ..... 292/113
6,527,309 B1 * 3/2003 Gaydos et al. ..... 292/128
6,789,692 B2 * 9/2004 Prezelin ..... 220/324
6,955,381 B2 * 10/2005 Parker et al. ..... 292/113
7,370,891 B1 * 5/2008 Schmitt et al. ..... 292/113
7,540,364 B2 * 6/2009 Sanderson ..... 190/119
7,837,053 B2 * 11/2010 Arnett et al. ..... 220/326
2004/0178202 A1 * 9/2004 Serio, Jr. ..... 220/324
2006/0017293 A1 * 1/2006 Tonelli ..... 292/202
2006/0042897 A1 * 3/2006 Sanderson ..... 190/120

* cited by examiner

*Primary Examiner* — Carlos Lugo
(74) *Attorney, Agent, or Firm* — Modiano & Associati; Albert Josif; Daniel J. O'Byrne

(57) ABSTRACT

A lock for carrying cases comprises at least one block hinged at a first end to a first half-shell. The block is rotatable about a pivoting axis from a closed configuration, in which at least one tab that protrudes on the opposite side with respect to the pivoting axis engages elastically and detachably a perimetric ridge that protrudes from a second half-shell, to couple the first half-shell to the second half-shell, to an opening configuration, in which the tab is disengaged from the ridge, and vice versa. The lock comprises a lever, which is hinged to the block at a first end portion thereof and can be gripped at a second end portion thereof, which is opposite to the first one, for the rotation of the block and the disengagement of the tab from the ridge.

5 Claims, 3 Drawing Sheets

LOCK, PARTICULARLY FOR SUITCASES, TRUNKS AND THE LIKE

The present invention relates to a lock, particularly for suitcases, trunks, carrying cases and the like.

BACKGROUND OF THE INVENTION

Portable containers (such as suitcases, trunks, bags, carrying cases et cetera) are currently commercially widespread which are constituted by a pair of mutually articulated half-shells which are affected, at respective edges, by the action of one or more locks capable of ensuring a hermetic seal in the closed configuration and the preservation of such seal, avoiding the danger of accidental opening.

In particular, with reference to specific fields of application of a professional type, the hermetic seal, and more generally the integrity of the suitcase and of its contents, must be ensured even after violent knocks and impacts, such as for example those occurring as a consequence of a fall, which instead in a suitcase of a traditional type might cause it to open.

There is, therefore, a widespread resort to structurally complicated locks, which achieve the above stated aim by oversizing the involved parts.

Accordingly, these bulky locks are scarcely practical and maneuverable, increasing even substantially, and therefore undesirably, the overall weight of the product and requiring the user to apply a considerable manual effort in order to provide the release, and therefore the voluntary opening, of the suitcase.

To obviate these drawbacks, locks have been marketed which are provided with means for the rapid release of a clamp designed to fasten the two half-shells: such means are constituted for example by a lever which is hinged to the clamp and can be operated manually to make it abut against the clamp, releasing it and thus opening the container.

Even these constructive solutions, however, are not free from drawbacks.

Due to the considerable dimensions of the parts involved, the extent of the force that must be applied to the lever in order to achieve release often assumes excessive values, such as to make it awkward to open the lock.

Moreover, the need to resort to a plurality of distinct elements leads to the provision of locks which are in any case complicated and particularly subject to breakage and/or deterioration caused by wear of the parts and by prolonged contact with dust and other impurities.

SUMMARY OF THE INVENTION

The aim of the present invention is to solve the above-mentioned drawbacks, by providing a lock that ensures preservation of the closed configuration and the hermetic seal of the container to which it is applied with a practical and easy solution.

Within this aim, an object of the invention is to provide a lock that ensures that the closed condition is maintained even after impacts and falls.

Another object of the invention is to provide a lock that is highly resistant to the effects of weather and to impurities of various types.

Another object of the invention is to provide a lock that can be applied to existing suitcases and other containers.

Another object of the invention is to provide a lock that ensures high reliability in operation.

Another object of the invention is to provide a lock that can be obtained easily starting from commonly commercially available elements and materials.

Another object of the invention is to provide a lock that has low costs and is safe in application.

This aim and these and other objects, which will become better apparent hereinafter, are achieved by a lock, particularly for suitcases, trunks and the like, comprising at least one block which is hinged, substantially at a first end thereof, to a first half-shell of a suitcase, said block being able to rotate about the pivoting axis from a configuration for closing the suitcase, in which at least one tab that protrudes on the opposite side with respect to the pivoting axis engages elastically and detachably a perimetric ridge that protrudes from a second half-shell of the suitcase, to couple the first half-shell to the second half-shell, to a configuration for opening the suitcase, in which said tab is disengaged from the ridge, and vice versa, characterized in that it comprises a lever, which is hinged to said block at a first end portion thereof and can be gripped at a second end portion thereof, which is opposite to the first one, for the rotation of said block and the disengagement of said tab from the ridge, with consequent transition from the closed configuration to the open configuration, said lever having a protrusion that can engage by interlocking elastically the ridge at said closed configuration, in order to strengthen the coupling of the first half-shell to the second half-shell, said protrusion being disengageable from the ridge independently of said block.

BRIEF DESCRIPTION OF THE DRAWINGS

Further characteristics and advantages of the invention will become better apparent from the following detailed description of a preferred but not exclusive embodiment of the lock according to the invention, illustrated by way of non-limiting example in the accompanying drawings, wherein.

DESCRIPTION OF THE PREFERRED EMBODIMENTS

Figure 2:
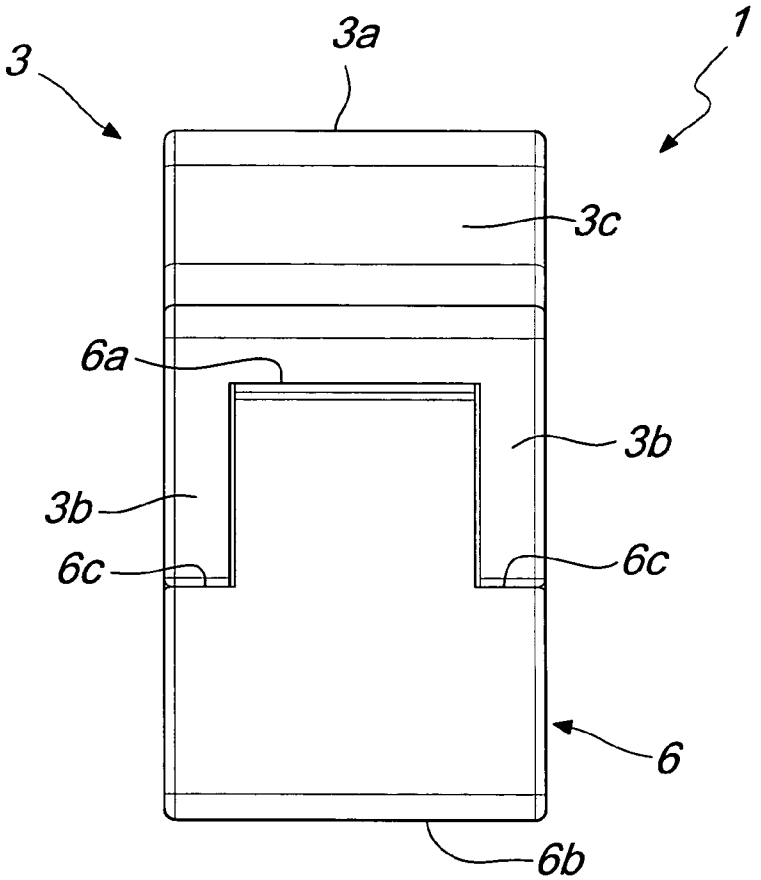
FIG. 2 is a front elevation view of the lock according to the invention.
Figure 1:
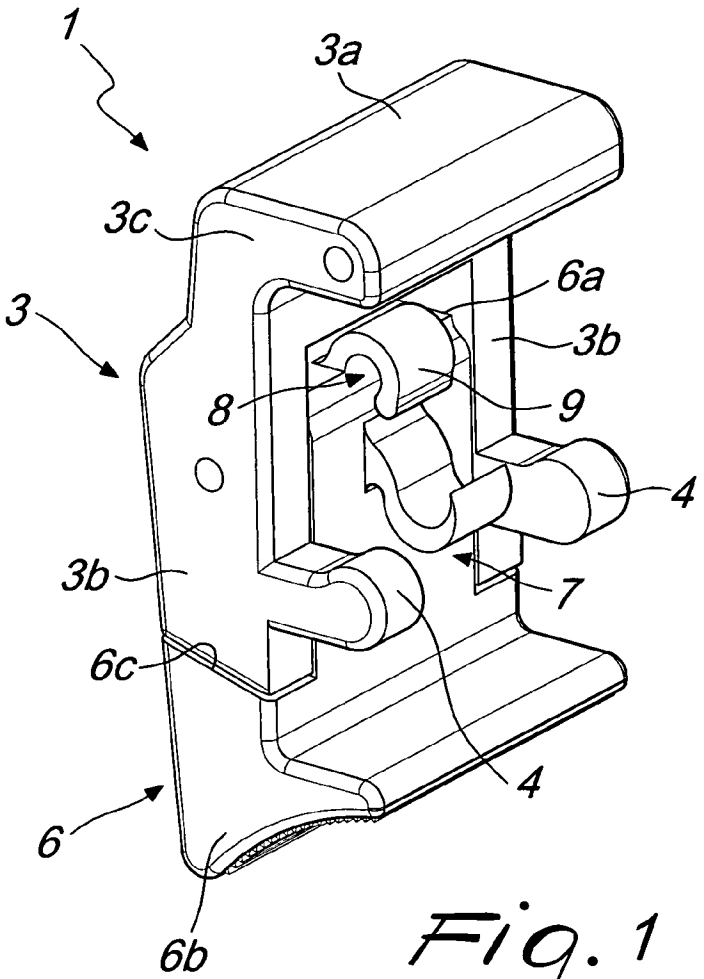
FIG. 1 is a perspective view of a lock according to the invention.

With reference to the figures, a lock according to the invention, generally designated by the reference numeral 1, is particularly suitable for fitting to suitcases 2, trunks and the like. In greater detail, in the continuation of the present description, constant reference shall be made to the embodiment (shown in the accompanying figures) that uses the lock 1 according to the invention to close a suitcase 2.

It should be specified immediately that the suitcase 2 can be of any type or size; equivalently, locks 1 according to the invention can be provided on trunks, bags or other types of container (portable or not) without thereby abandoning the protective scope claimed herein.

The lock 1 comprises at least one block 3, which is hinged, substantially at a first end 3*a*, to a first half-shell 2*a* of the suitcase 2. The block 3 can rotate about the pivoting axis A in order to pass from a closed configuration of the suitcase 2 to an open configuration of the suitcase 2, and vice versa.

In the closed configuration, at least one tab 4 that protrudes on the opposite side with respect to the pivoting axis engages elastically and detachably (for example by interlocking) a perimetric ridge 5 that protrudes from a second half-shell 2*b* of the suitcase 2, in order to couple the first half-shell 2*a* to the second half-shell 2*b*.

In the open configuration, instead, the tab 4 is disengaged from the ridge 5 and it is therefore possible to access the compartment inside the suitcase 2.

The suitcase 2, according to the embodiment shown in the accompanying figures by way of non-limiting example of the application of the invention, is therefore constituted by the first half-shell 2*a* and by the second half-shell 2*b*, which are mutually articulated in two or more hinges and are kept in mutual contact, in the closed configuration, by one or more locks 1 and by the respective blocks 3.

According to the invention, the lock 1 comprises a lever 6, which is hinged to the block 3 at a first end portion 6*a* thereof and can be gripped at a second end portion 6*b* thereof, which lies opposite the first one, in order to allow a user to turn the block 3 and disengage the tab 4 from the ridge 5, with consequent transition from the closed configuration to the open configuration.

Moreover, the lever 6 has a protrusion 7, which can engage by interlocking and elastically the ridge 5 at the closed configuration, in order to strengthen the coupling of the first half-shell 2*a* to the second half-shell 2*b*; the protrusion 7 can be disengaged from the ridge 5 independently of the block 3.

Usefully, the lever 6 has, substantially at the first end portion 6*a*, an elastically deformable member 8, which is interposed between the lever 6 and the suitcase 2.

Figure 4:
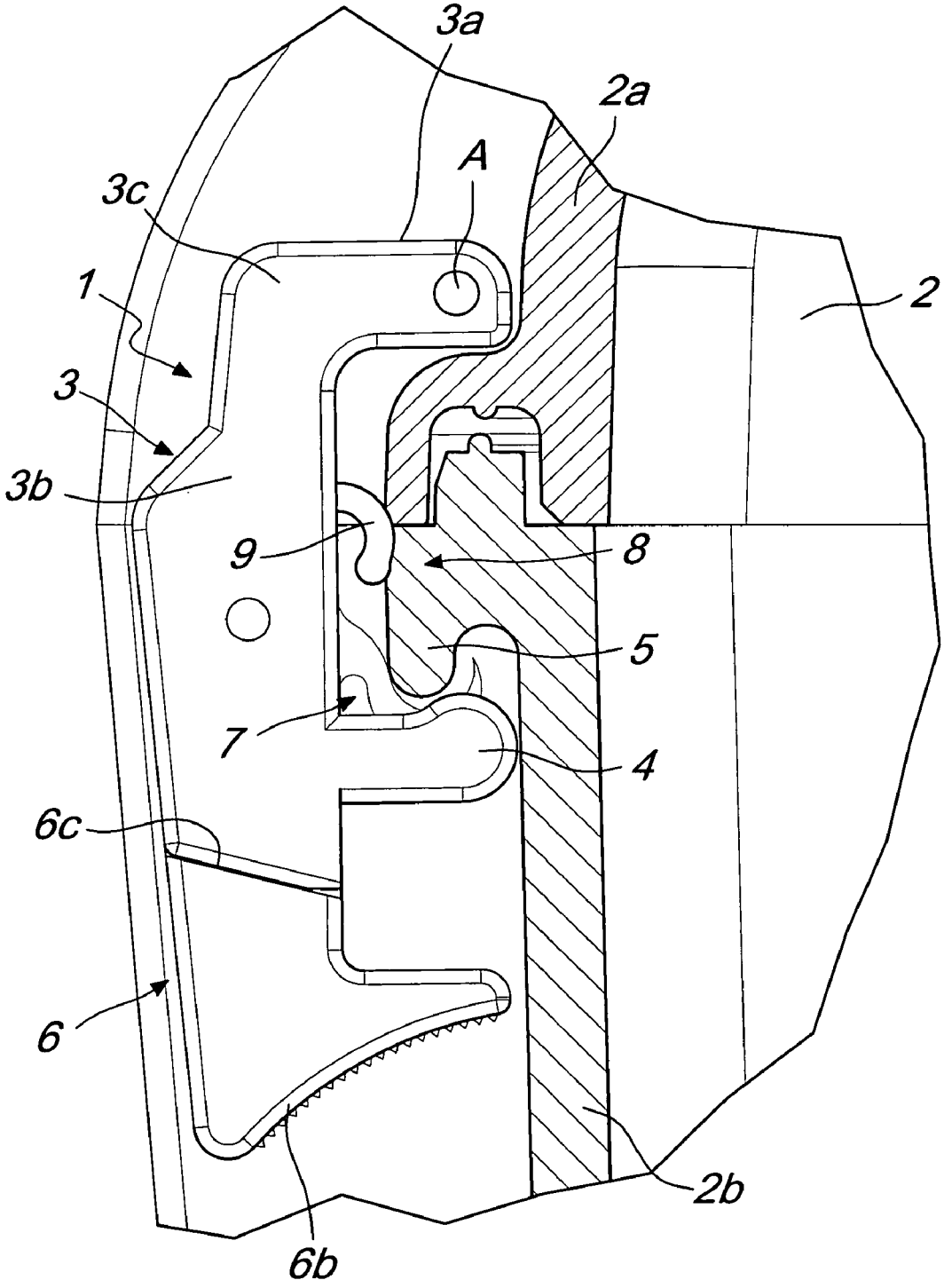
FIG. 4 is a highly enlarged-scale view of a detail of FIG. 3.

At the closed configuration, the elastic reaction of the member 8 automatically keeps the protrusion 7 engaged with the ridge 5, as can be seen from FIG. 4.

Vice versa, by applying to the second end portion 6*b* of the lever 6 such a traction as to overcome the elastic reaction of the member 8, said member is compressed elastically and the lever 6 is turned, thus disengaging the protrusion 7 from the ridge 5.

According to an embodiment of substantial practical interest, which is shown in the accompanying figures by way of non-limiting example of the application of the invention, the elastically deformable member 8 is constituted substantially by a hook 9; as can be seen in particular from FIG. 4, the curved portion of the hook 9 faces and is proximate to the suitcase 2 and abuts against it in the closed configuration.

According to a further embodiment, the elastically deformable member 8 is instead constituted substantially by a spring, which is coupled at one of its ends which is fixed to the lever 6 and abuts with its free end against the suitcase 2 in the closed configuration.

Moreover, the possibility is not excluded to provide the lock 1 according to the invention with members 8 of a different type, such as for example a simple insert made of elastically deformable material that is fixed (optionally co-molded) to the lever 6 and is interposed between said lever and the suitcase 2.

The protective scope claimed herein further includes embodiments in which members 8 (for example hooks 9) are arranged also (or only) on the block 3: in a manner similar to what has been noted earlier for the hooks 9 fitted on the lever 6, the choice to fix hooks 9 to the block 3 allows to keep the tab 4 engaged with the ridge 5.

With reference to the preferred embodiment (which however does not limit the application of the invention), the block 3 is constituted substantially by two lateral arms 3*b*, which are joined in a U-shape by a crossmember 3*c*. The crossmember 3*c* defines substantially the pivoting axis of the block 3 to the first half-shell 2*a*; a concavity comprised between the two lateral arms 3*b* accommodates at least one portion of the lever 6, while a respective tab 4, which can be engaged with the ridge 5, protrudes from each one of the lateral arms 3*b*.

Advantageously, the lever 6 has surface portions that are adapted to abut against respective regions of the block 3 at a predefined angular position of the lever 6 with respect to the block 3.

For example, said surface portions can be constituted by the first end portion 6*a*, whose trajectory during the rotation of the lever 6 can affect, by means of an appropriate size selection, the central region of the crossmember 3*c* of the block 3.

As an alternative, said surface portions can be constituted by shoulders 6*c* formed proximate to the second end portion 6*b*; the shoulders 6*c* can affect, during the rotation of the lever 6, the free ends of the lateral arms 3*b* of the block 3.

Whatever the choice of the surface portions, the rotation of the lever 6 from the closed configuration for values of rotation angles that are smaller than the predefined angular position allow to disengage the lever 6 from the ridge 5, without however disengaging the block 3 from the ridge 5.

A further rotation beyond said angular position determines instead an action of the lever 6 on the block 3, which can thus be lifted until the block 3 disengages from the ridge 5 and transition to the open configuration occurs.

Conveniently, the lock 1 according to the invention comprises locking means, which can be activated and deactivated on command and are adapted to contrast the rotation of at least one between the block 3 and the lever 6, in order to prevent the transition from the closed configuration to the open configuration.

Said means might be constituted for example by a padlock of a known type, which can be activated and deactivated by means of a key, and prevent opening of the suitcase 2 by anyone who does not have said key, avoiding the risk of unwanted accesses to the content of the suitcase 2.

The use of the lock according to the invention is as follows.

Figure 3:
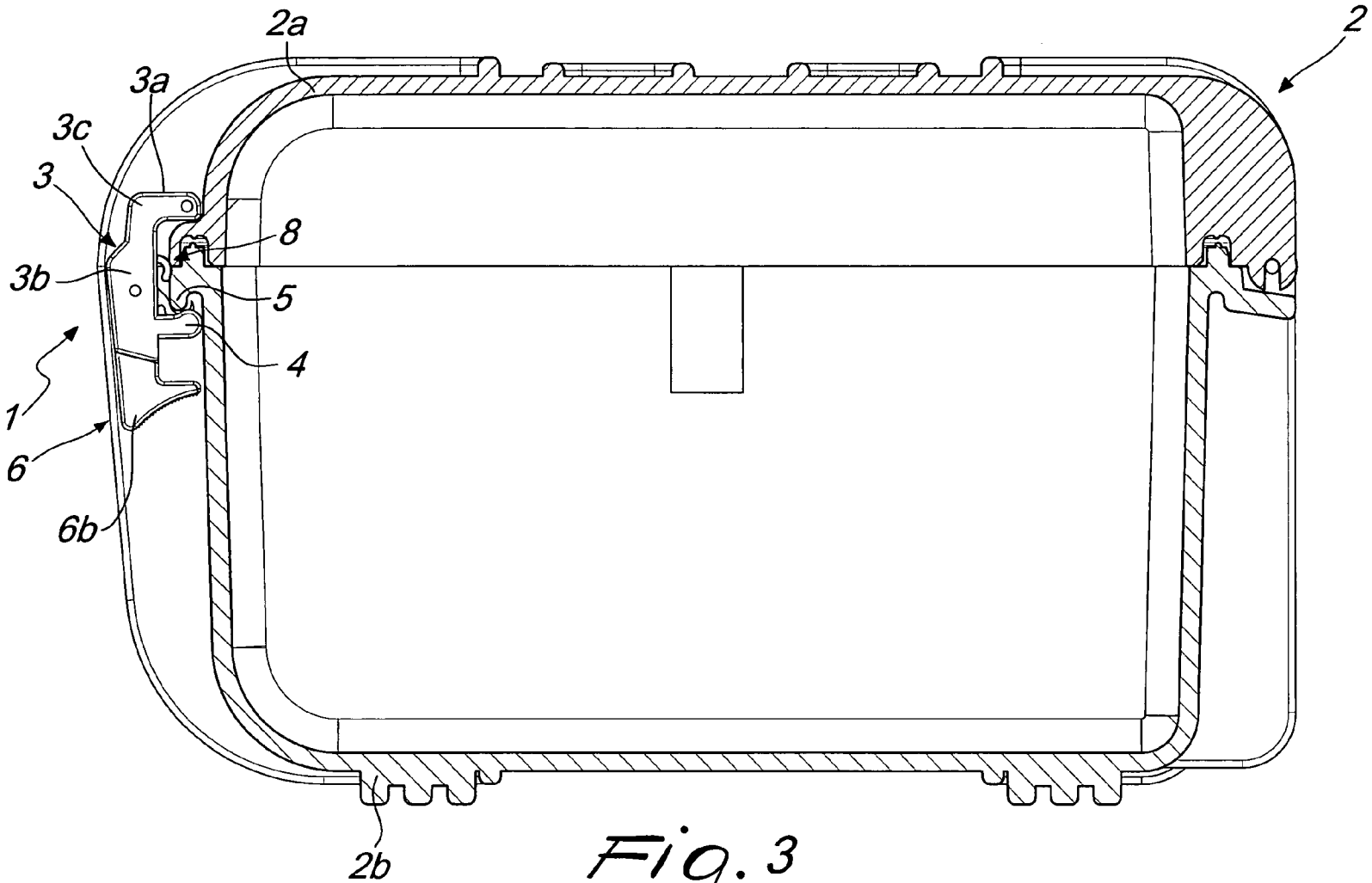
FIG. 3 is a partially sectional side elevation view of the lock fitted to a portable container.

With the lock 1 in the closed configuration (shown in FIGS. 3 and 4), the block 3 and the lever 6 substantially adhere to the walls of the suitcase 2, and thanks to the tab 4 and the protrusion 7, which are both engaged with the ridge 5, the first half-shell 2*a* is coupled stably to the second half-shell 2*b*.

The presence of the protrusion 7 therefore allows to strengthen the coupling already established by the presence of the tab 4, in order to prevent the accidental release of the lock 1 as a consequence of impacts, falls or knocks. This result is achieved, differently from what occurs in the background art, with a solution that is simple (the lock 1 is composed substantially of just two elements, the block 3 and the lever 6) and has low weights and dimensions.

The choice to use an extremely small number of elements further allows to contain to a minimum the number of components of the bill of materials needed to provide the lock 1 according to the invention and therefore to reduce the risk of breakage or jamming caused by malfunctions.

The simplicity of the couplings provided is further substantially insensitive to the action of atmospheric agents and more generally of the impurities that are present in the air, giving further reliability to the lock 1 according to the invention.

Moreover, as already noted, in the closed configuration the elastic reaction of the elastically deformable member 8 keeps the protrusion 7 automatically mated with the ridge 5 and is therefore a further assurance of the stability of the coupling.

If a user wishes to open the suitcase 2 and therefore have access to its content, he/she can act, by lifting it, on the lever 6, and in particular on the second end portion 6*b*, which can further have, as in the accompanying figures, a knurling such as to further aid grip and facilitate the task of the user.

As anticipated in the preceding paragraphs, by acting on the lever 6 a compression of the member 8 and a rotation of the lever 6 are achieved until first of all the protrusion 7 is disengaged from the ridge 5 (and therefore the lever 6 is disengaged from the second half-shell 2*b*). This result can be achieved by applying a force of modest extent (also thanks to the possibility to resort to the lever 6 and therefore to a large lever arm), without therefore requiring excessive efforts to the user.

The lever 6 can thus be actuated manually in order to allow disengagement of the protrusion 7 from the ridge 5, independently of the block 3, which in this step remains engaged with the second half-shell 2*b* (which therefore is still coupled to the first half-shell 2*a* while the suitcase 2 is closed).

After releasing the lever 6 in the manner described above, by lifting it further it is possible to make it reach the predefined angular position in which some of its surface portions abut against respective regions of the block 3. By applying a further traction to the lever 6 it is possible to produce a consequent further rotation thereon, thus making the tab 4 disengage from the ridge 5 and thus passing to the open configuration of the suitcase 2.

Again, the force to be applied to complete the opening of the suitcase 2 is modest, ensuring the desired practicality and maneuverability of the lock 1 according to the invention.

It is evident that in order to close the suitcase 2 again, it is sufficient to press the lever 6 against the walls of the suitcase 2 in order to restore the double coupling between the tab 4 and the ridge 5 and between the protrusion 7 and again the ridge 5.

It should be noted that during the closure of the suitcase 2, the hook 9 or other member 8 abuts against the walls of the suitcase 2, and its elastic reaction facilitates the mating between the protrusion 7 and the ridge 5.

Moreover, it should be noted that by means of a suitable size selection it is possible to obtain a particularly stable and firm coupling between the protrusion 7 and the ridge 5, such as to ensure a high resistance to impacts (optionally in view of a weak coupling between the tab 4 and the ridge 5) while keeping low the force needed for disengagement by means of the rotation to be imparted to the lever 6.

In this regard, it is specified that the protective scope defined herein includes embodiments that have various lengths of the lever 6 and different mutual positions of the pivoting axis of the block 3 with respect to the first half-shell 2*a* and of the rotation axis of the lever 6 around the block 3.

The placement of these axes and the length of the lever arm in fact determine the forces and the torques needed to lock and release the lock 1, and therefore contribute to control the ease, or lack thereof, of opening of the lock 1.

Finally, it should be noted that the lock 1 according to the invention requires the presence on the suitcase 2 of a simple folded edge that forms the ridge 5, without providing other elements thereon.

Said edges are widespread on commercially available suitcases and trunks, thus allowing the application of the lock 1 according to the invention also on existing containers, without requiring further interventions or modifications thereon.

In practice it has been found that the lock according to the invention fully achieves the intended aim, since the desired retention of the closed configuration and the desired hermetic seal of the container to which it is applied with a practical and easy solution are ensured by the presence of the lever, which can be gripped to turn the block that keeps the suitcase closed and to which it is hinged, and by the protrusion provided on said lever, which also engages the second half-shell of the suitcase in order to strengthen the coupling and can be disengaged independently of the block.

The invention thus conceived is susceptible of numerous modifications and variations, all of which are within the scope of the appended claims; all the details may further be replaced with other technically equivalent elements.

In the exemplary embodiments shown, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the dimensions, may be any according to requirements and to the state of the art.

What is claimed is:

1. A lock for suitcases, trunks and carrying cases, comprising:

a first and a second half-shells;

at least one block which is hinged at a first end thereof to a pivoting axis, to the first half-shell; and a lever, which is hinged to said block at a first lever end portion;

wherein said block is constituted by two lateral arms which by a crossmember so as to form a U-shape with a concavity comprised between said two lateral arms, said crossmember forming said pivoting axis and said concavity comprised between the two lateral arms accommodating at least one portion of said lever, said block having, extending from each one of said lateral arms, a respective tab that protrudes on an opposite side with respect to the pivoting axis, wherein said block is able to rotate about said pivoting axis from a configuration for closing together the first and second half-shells, in which said tabs are suitable to be engaged elastically and detachably with a perimetric ridge that protrudes from the second half-shell, to couple the first half-shell to the second half-shell, to a configuration for opening the first and second half-shells, in which said tabs are suitable to be disengaged from the ridge, and vice versa;

and wherein said lever has a second end portion thereof that is suitable for gripping, and is opposite to the first end portion in order to actuate rotation of said block and disengagement of said at least one tab from said ridge, with consequent transition from the closed configuration to the open configuration, said lever having further a protrusion that is shaped so as to engage by interlocking elastically the ridge at said closed configuration, in order to strengthen coupling of the first half-shell to the second half-shell, said protrusion being disengageable from the ridge independently of said block.

2. The lock of claim 1, wherein said lever has, at said first end portion, an elastically deformable member, which is interposed between said lever and the half-shells, an elastic reaction of said deformable member keeping said protrusion engaged with the perimetric ridge at said closed configuration, and a traction action on said second end portion being suitable to produce an elastic compression of said member in order to allow rotation of said lever and disengagement of said protrusion from the ridge.

3. The lock of claim 2, wherein said elastically deformable member is constituted by a hook, a curved portion of said hook facing, and being proximate to, the half-shells and abutting against them in said closed configuration.

4. The lock of claim 1, wherein said lever has surface portions that are adapted to abut, at a predefined angular position of said lever with respect to said block, against respective regions of said block, a rotation of said lever from said closed configuration to said predefined angular position being suitable to cause disengagement of said lever from the ridge, a further rotation, beyond said predefined angular position, being suitable to cause disengagement of said block from the ridge and the transition to said open configuration.

5. The lock of claim 1, comprising locking means, which can be activated and deactivated on command and are adapted to contrast rotation of at least one between said block and said lever, in order to prevent transition from said closed configuration to said open configuration.

* * * * *